US007762532B2

(12) United States Patent
Campbell et al.

(10) Patent No.: US 7,762,532 B2
(45) Date of Patent: Jul. 27, 2010

(54) LOAD EQUALIZING ROPE TERMINATION AND METHOD

(75) Inventors: Geoffrey George Campbell, Kensington (AU); Alexander McKechran Hardie McNeil, Gladesville (AU)

(73) Assignee: JLG Industries, Inc., McConnellsburg, PA (US)

( * ) Notice: Subject to any disclaimer, the term of this patent is extended or adjusted under 35 U.S.C. 154(b) by 897 days.

(21) Appl. No.: 11/581,783

(22) Filed: Oct. 17, 2006

(65) Prior Publication Data

US 2008/0142309 A1 Jun. 19, 2008

(51) Int. Cl.
*B66D 1/00* (2006.01)

(52) U.S. Cl. ..... 254/277; 24/115 F; 24/132 R

(58) Field of Classification Search ..... 254/277, 254/285; 24/115 F, 132 R
See application file for complete search history.

(56) References Cited

U.S. PATENT DOCUMENTS

| | | | | |
|---|---|---|---|---|
| 460,647 | A | 10/1891 | Mills | |
| 788,992 | A | 5/1905 | Bauer | |
| 2,370,834 | A | 3/1945 | Ball | |
| 3,115,211 | A | 12/1963 | Ostrander, Jr. | |
| 3,675,898 | A * | 7/1972 | Fattor et al. | 254/134.3 FT |
| 3,677,521 | A * | 7/1972 | Kinnicutt, Jr. | 254/283 |
| 3,737,007 | A | 6/1973 | Herrell | |
| 3,752,263 | A | 8/1973 | Thevenot | |
| 3,765,063 | A * | 10/1973 | Farley | 410/116 |
| 3,903,785 | A * | 9/1975 | Pepper, Jr. | 248/694 |
| 4,049,081 | A | 9/1977 | McDonald et al. | |
| 4,077,697 | A * | 3/1978 | Yates | 439/711 |
| 4,183,423 | A | 1/1980 | Lewis | |
| 4,194,591 | A | 3/1980 | Fisher | |
| 4,427,094 | A | 1/1984 | Winkelblech | |
| 4,481,695 | A * | 11/1984 | Koster et al. | 24/32 |
| 4,512,440 | A | 4/1985 | Bixby | |
| 4,592,447 | A | 6/1986 | Ream et al. | |
| 5,044,473 | A | 9/1991 | Gripe | |
| 6,095,284 | A | 8/2000 | Smith | |
| 6,471,004 | B2 | 10/2002 | Stringer et al. | |
| 7,313,975 | B1 * | 1/2008 | Scorteanu | 73/862.454 |

FOREIGN PATENT DOCUMENTS

| | | |
|---|---|---|
| EP | 0 192 170 | 8/1986 |
| EP | 0 931 757 | 7/1999 |
| FR | 2 081 769 | 12/1971 |
| GB | 2 211 237 | 6/1989 |

* cited by examiner

*Primary Examiner*—Emmanuel M Marcelo
(74) *Attorney, Agent, or Firm*—Nixon & Vanderhye P.C.

(57) ABSTRACT

A load equalizing rope termination serves to prevent a load imbalance between a pair of rope leads of a rope termination. The rope termination includes an end section such as an end loop and the pair of rope leads attached to a pair of rope ends. A rope termination fitting includes a base support member over which the end section is supported, and a pair of load equalizing support members disposed upstream of the base support member and over which the rope ends are supported. The engagement between the rope ends and the equalizing support members prevents a load imbalance of the rope leads.

10 Claims, 8 Drawing Sheets

LOAD EQUALIZING ROPE TERMINATION AND METHOD

CROSS-REFERENCES TO RELATED APPLICATIONS (Not Applicable)

STATEMENT REGARDING FEDERALLY SPONSORED RESEARCH OR DEVELOPMENT (Not Applicable)

BACKGROUND OF THE INVENTION

The present invention relates to force distribution and load balancing and, more particularly, to a load equalizing rope termination and method that prevent a load imbalance on a pair of rope leads.

A lifting or winch system is known where a driving pulley, cable, chain, tape, rope or the like (hereinafter "rope") is attached to a rotating drum or other motive power source. At its end, the rope is secured to the object to be lifted or pulled. The drum is fixed relative to the object to be moved. As the drum is rotated, the rope is taken up around the drum, and the object to be moved is pulled.

In order to provide a level of redundancy, a pair of ropes with respective rope ends may be secured between the drum and the object to be lifted. A problem arises with this arrangement, however, if a load imbalance occurs on the rope ends. In the event of such a load imbalance, the object to be moved may be skewed or otherwise unevenly displaced, which thereby may prevent proper operation of the device.

BRIEF SUMMARY OF THE INVENTION

It would thus be desirable to develop structure cooperable with the rope termination that would prevent a load imbalance of the rope ends. The rope termination and method described herein utilize a rope termination fitting including one or more load equalizing support members. The support members receive a portion of the rope or an attachment to the rope to prevent the rope from an imbalanced load. The structure additionally ensures independence of the ropes as each is capable of supporting the load independently in the event one of the ropes fails.

In an exemplary embodiment of the invention, a load equalizing rope termination includes a pair of rope ends; a rope termination attached to the rope ends and defining an end section such as an end loop and a pair of rope leads; and a rope termination fitting. The rope termination fitting includes a base support member over which the end section is supported, and a pair of load equalizing support members disposed upstream of the base support member and over which the rope ends are supported. The engagement between the rope ends and the load equalizing support members prevents a load imbalance of the rope leads.

The load equalizing support members are preferably spaced from the base support member and aligned across a width of the base support member. The base support member and the load equalizing support members may be angled in a direction opposite from a load direction. In a preferred arrangement, the rope termination is spliced with the rope ends.

In another exemplary embodiment of the invention, a load equalizing rope termination includes a pair of rope ends; a rope termination attached to the rope ends and defining an end section and a pair of rope leads; and a rope termination fitting having structure coupled with the rope ends for preventing a load imbalance of the rope leads.

In yet another exemplary embodiment of the invention, a method of preventing a load imbalance on a rope termination defining an end section and a pair of rope leads includes the steps of attaching the rope termination to a pair of rope ends; securing the end section over a base support member; and securing the rope ends over a corresponding pair of load equalizing support members disposed upstream of the base support member.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
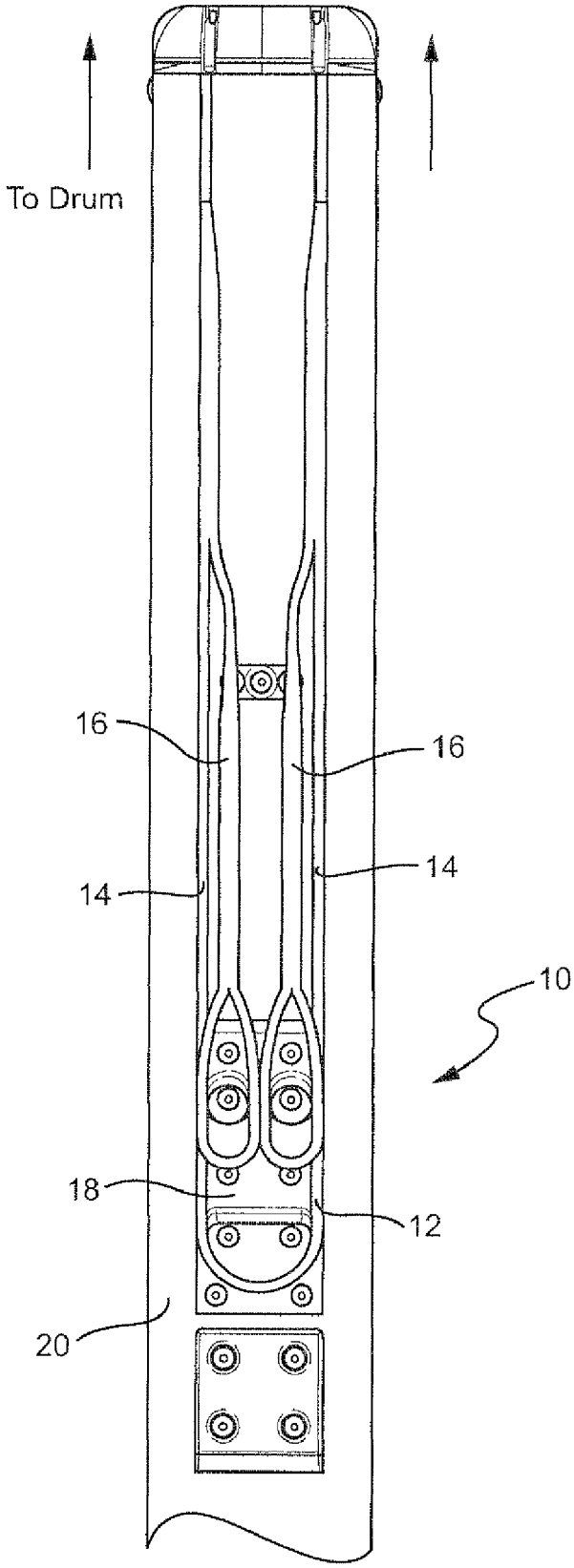
FIG. 1 shows the load equalizing rope termination in use including the rope and rope termination fitting.

With reference to FIG. 1, like a conventional redundant arrangement, a load equalizing rope termination includes a pair of rope ends 16. The rope ends 16 are attached at an opposite end to a rotating drum or the like. The ropes are configured such that either rope is independently capable of supporting the load, thus providing an added margin of safety in the event that one of the ropes breaks.

The rotating drum or the like may be fixed and the load movable at the distal ends of the ropes; or the drum may be attached to the movable load and move with the load with the distal ends of the rope fixed; or a combination of both. In a preferred arrangement, the drum is fixed, and the load, such as a work platform or the like, is restrained to move along a load path (e.g., with wheels on rails). If the ropes 16 are not identical in length, one of the ropes will carry a disproportionate share of the load. This is particularly so if the ropes are high in stiffness such as wire ropes or some pre-stretched polymer ropes or the like. If the ropes do not carry an equal share of the load, one rope may become slack enough to jump grooves on a grooved winch drum; the load may skew creating side loads on the wheels with increasing friction, wear and energy losses; or one rope may wear faster and thereby have a shorter useful life.

To address these concerns while maintaining redundant independent support by the rope ends 16, a rope termination 10 defining an end section such as an end loop 12 and a pair of rope leads 14 is spliced or otherwise attached to the rope ends 16. Any suitable manner of splicing the ropes together may be used, and the specific splicing method does not form part of the invention. As such, no further description will be provided.

A rope termination fitting 18 is fixed to an object to be moved (load) 20 via suitable connectors. The rope termination fitting 18 includes a base support member 22 over which the end loop 12 is supported, and two load equalizing support members 24 disposed upstream of the base support member 22 and over which the rope ends 16 are supported. The term "upstream" in this context is intended to encompass a direction in which a force on the rope termination 10 is pulling the rope termination fitting 18. In FIG. 1, the upstream direction is upward.

Figure 3:
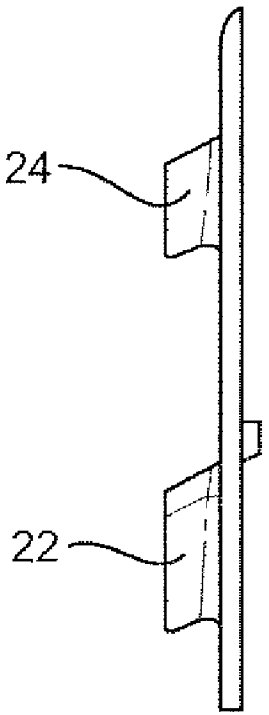
FIG. 3 is a side view of the rope termination fitting.
Figure 2:
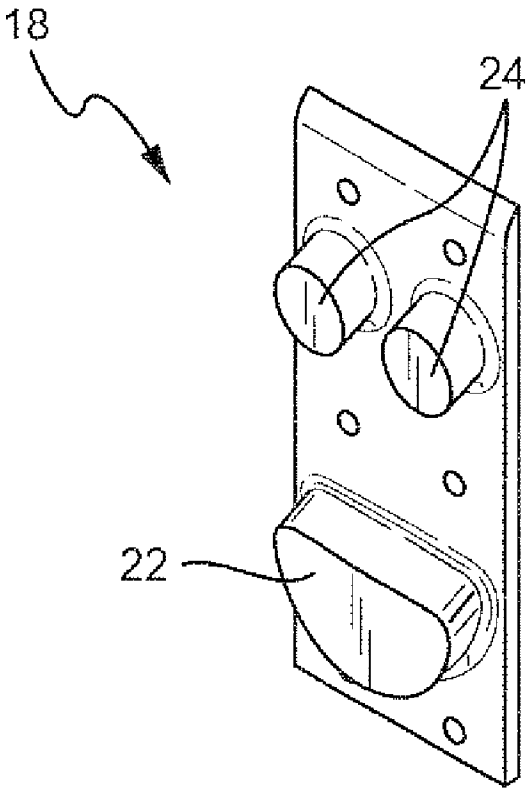
FIG. 2 is a perspective view of the rope termination fitting.
Figure 4B:
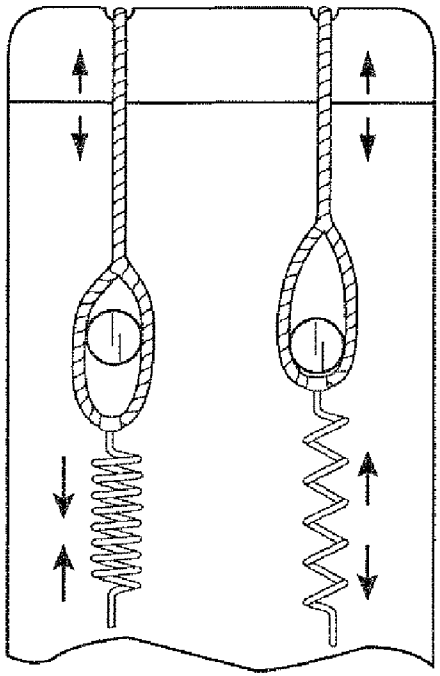
FIGS. 4A-9 show alternative concepts for the rope termination.
Figure 4A:
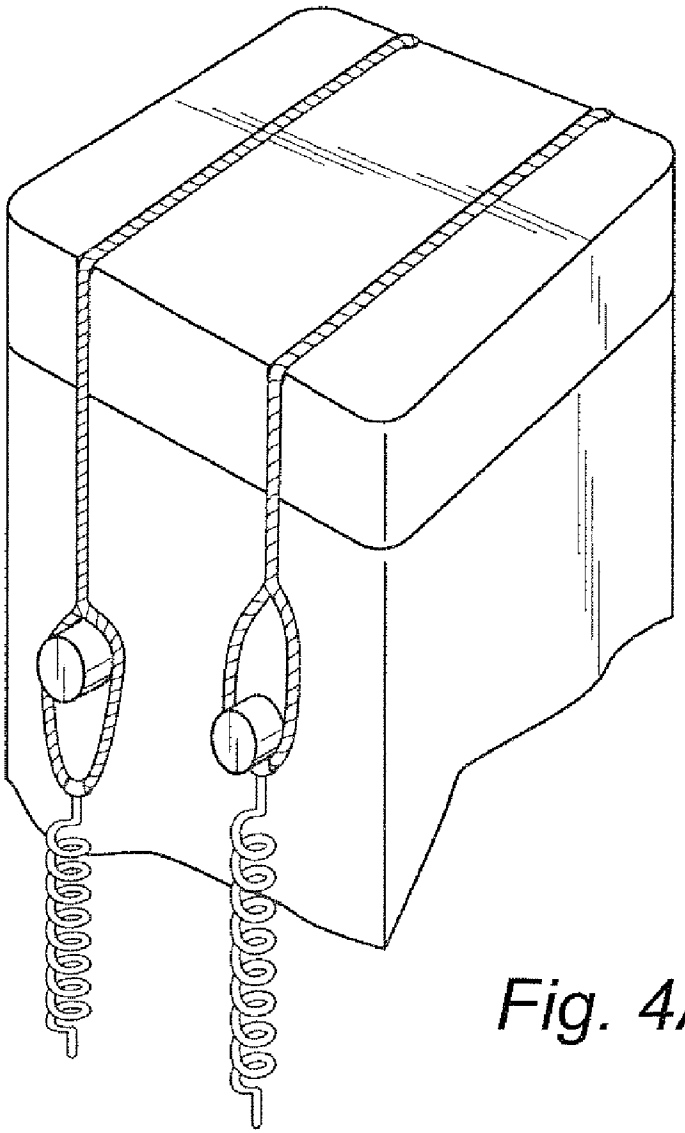
Figure 5B:
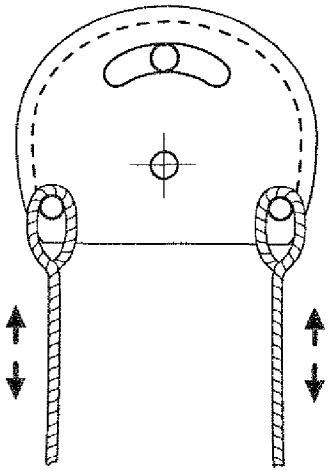
Figure 5C:
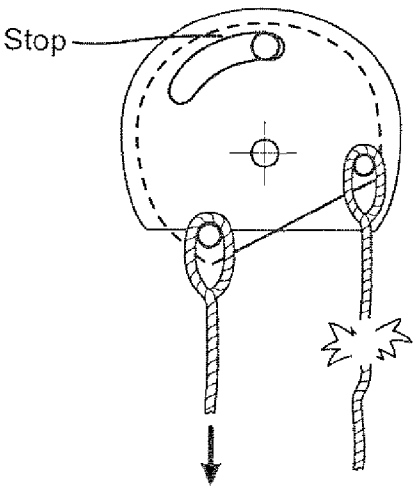
Figure 5A:
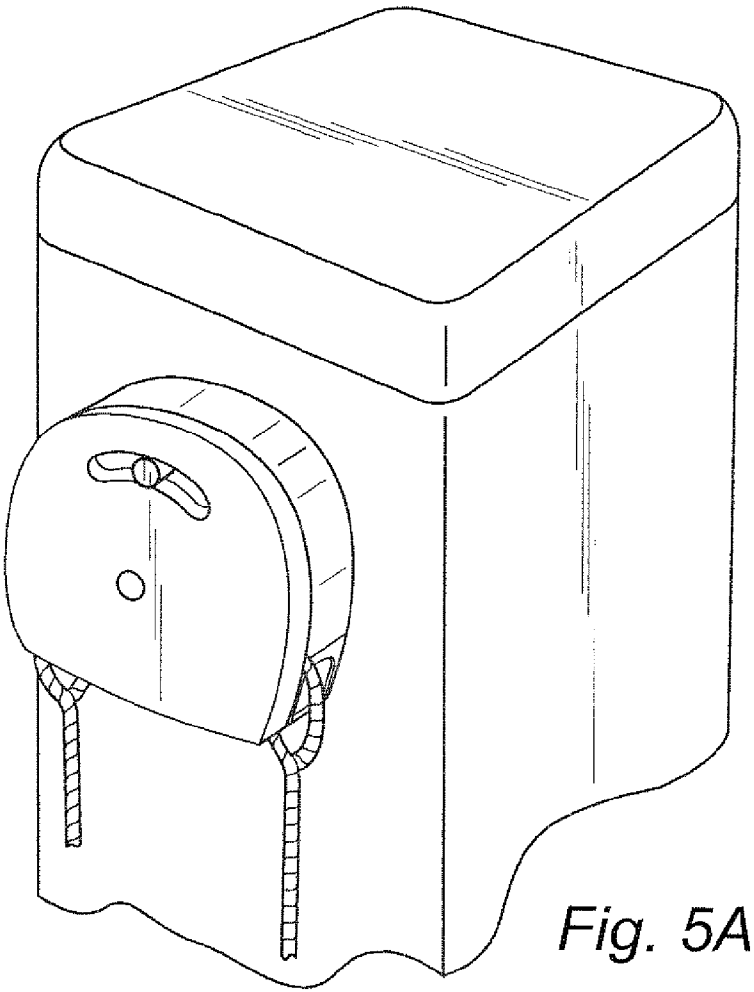
Figure 6B:
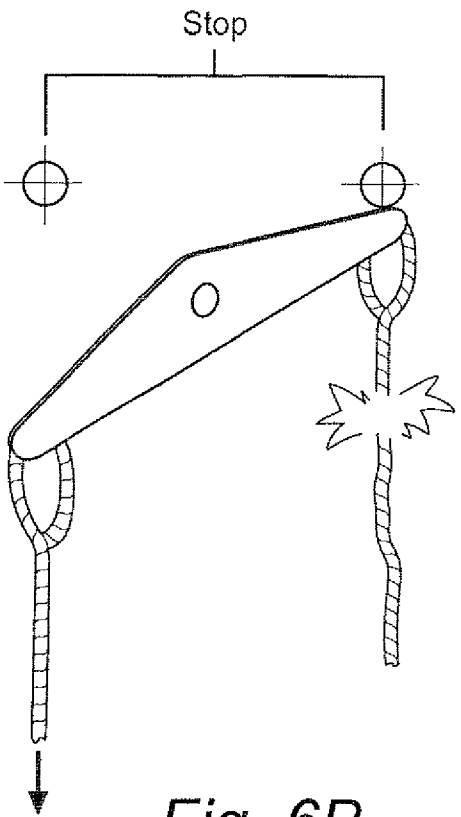
Figure 6A:
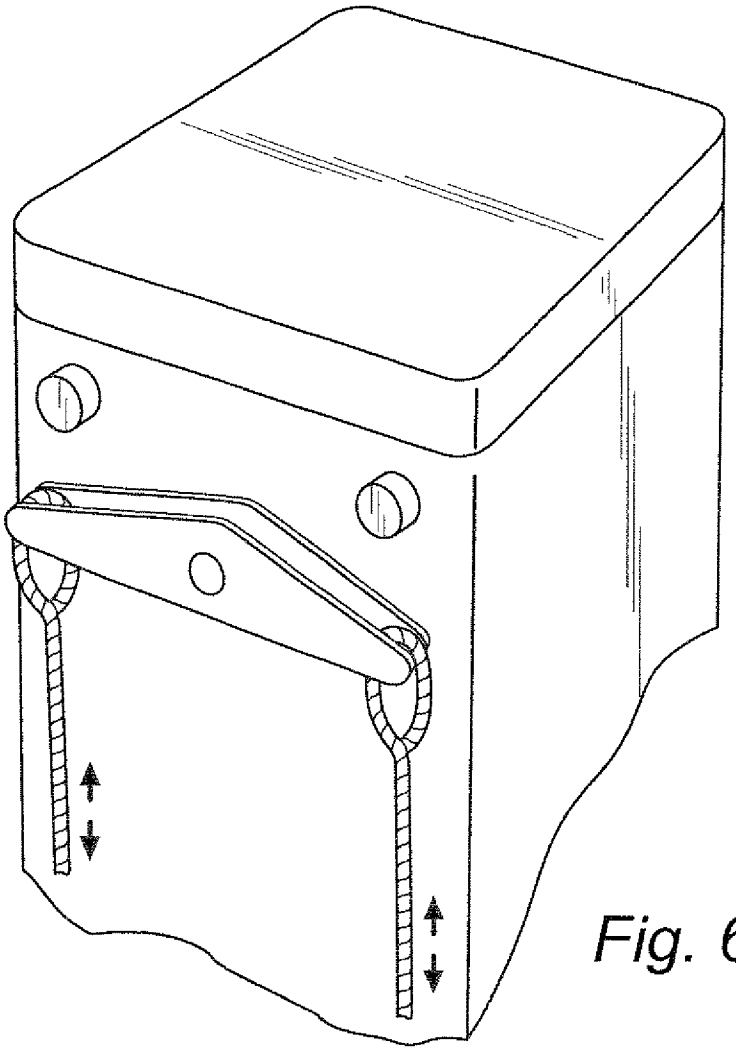
Figure 7B:
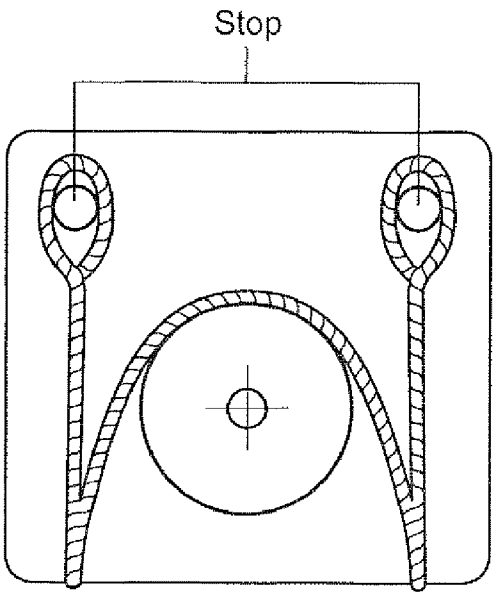
Figure 7A:
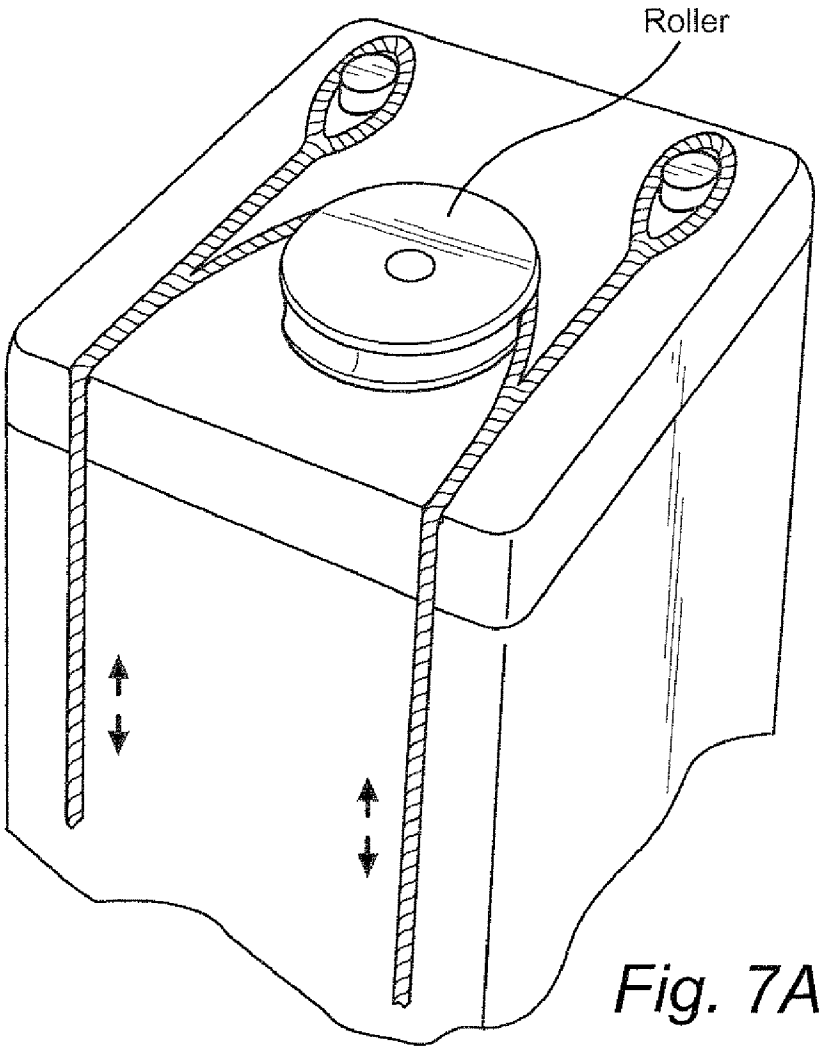
Figure 8B:
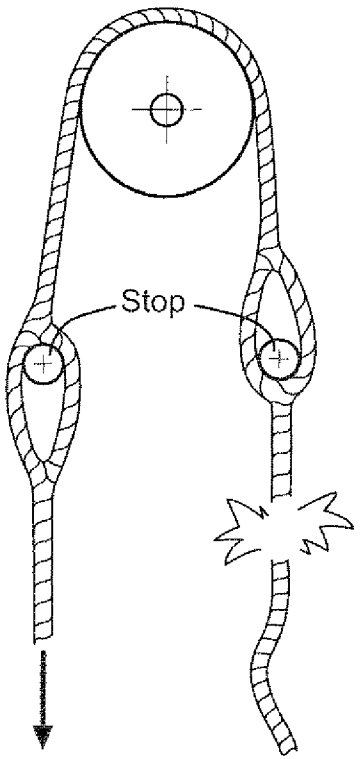
Figure 8A:
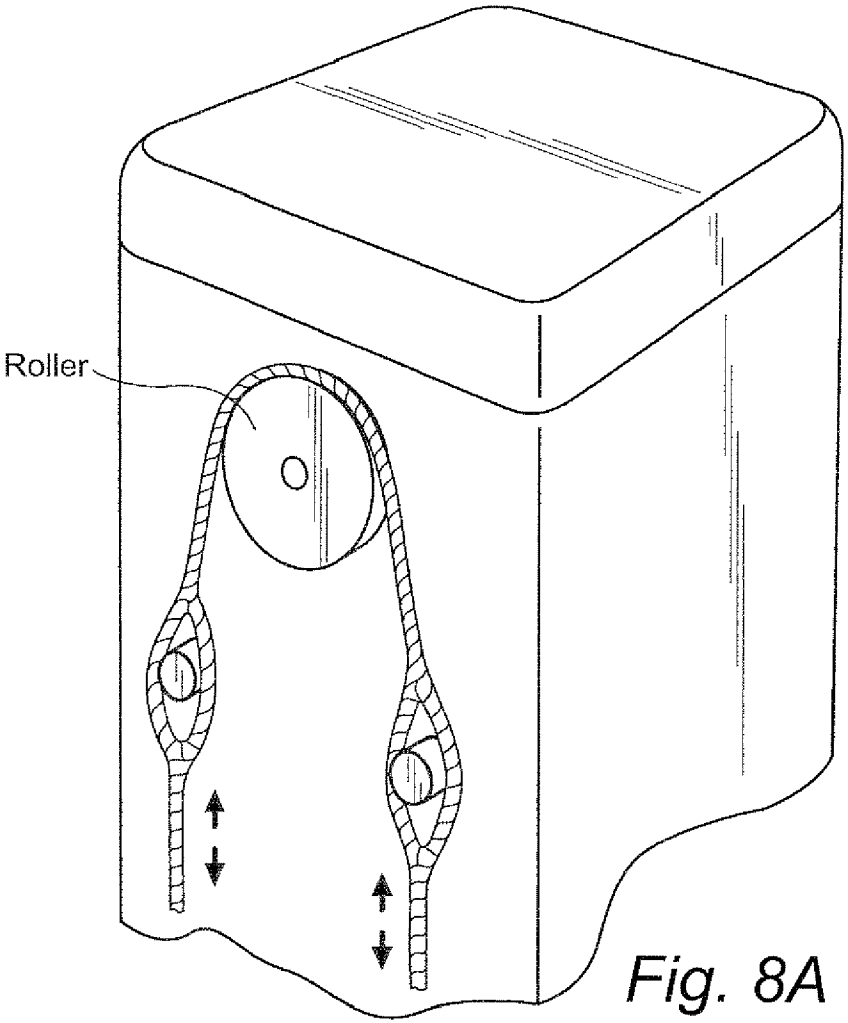
Figure 9:
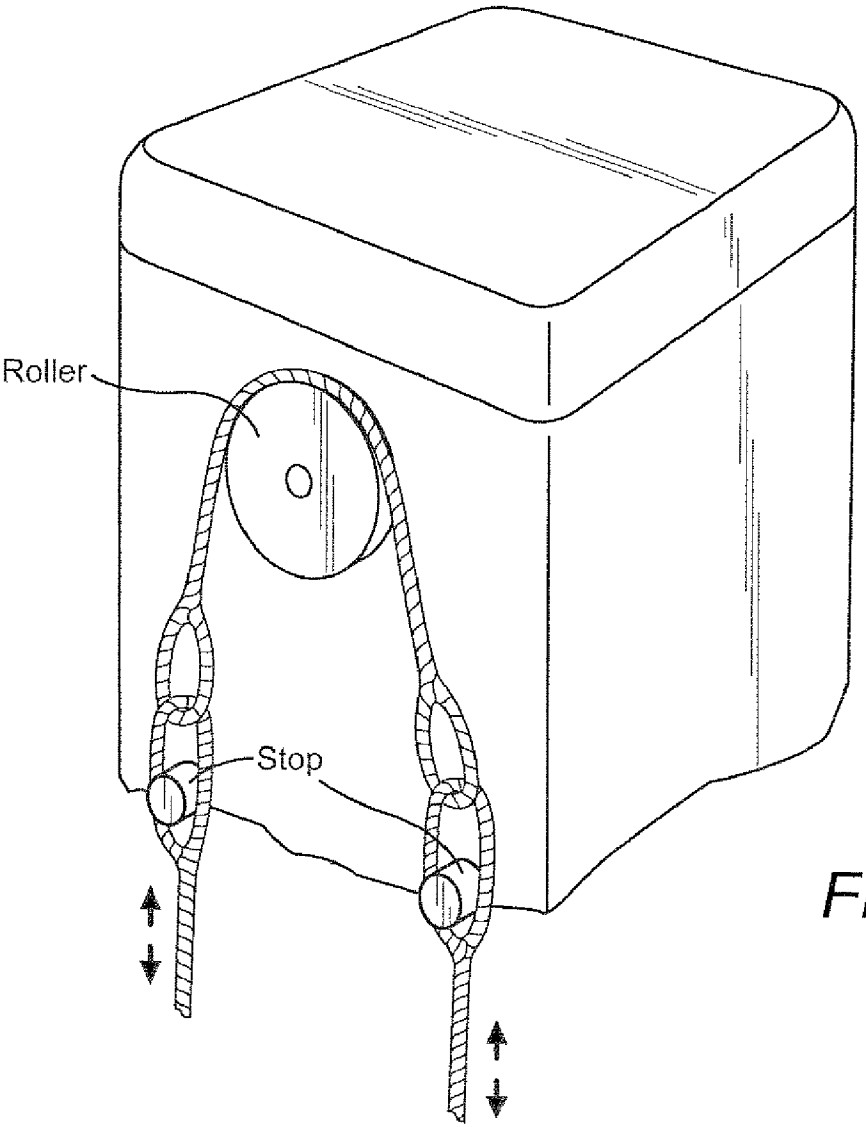

As shown in FIG. 2, the load equalizing support members 24 are spaced from the base support member 22 and are generally aligned across a width of the base support member 22. Additionally, with reference to FIG. 3, the base support member 22 and the load equalizing support members 24 are angled in a direction opposite from the load direction. In this manner, when a load is applied to the rope termination 10 (upward in FIG. 3), the downward angled base support member 22 and load equalizing support members 24 prevent the rope termination 10 from slipping off. A cover (not shown) over the rope termination fitting 18 further prevents the rope termination 10 from slipping off.

In use, as a rotating drum or other motive force applies a load to the rope termination 10, the end loop 12 or other end section is pulled against the base support member 22 while the rope ends 16 remain generally slack, and the rope termination fitting 18 and the movable object 20 to which it is attached are driven in the load direction. The rope ends 16 supported on the load equalizing support members 24 prevent a load imbalance of the rope leads 14. That is, an unbalanced load on the object to be moved 20, via friction, anomalies in the drum or the like may cause one of the rope leads 14 to be pulled at a different rate or load, thereby causing a load imbalance on the rope leads 14. Upon such an occurrence, the rope ends 16 engaging the respective load equalizing support members 24 prevent the rope leads from being driven unevenly, thereby preventing a load imbalance on the rope leads 14.

As noted, the configuration also serves to maintain a redundant load support as a safety feature in the event one of the rope leads 14, the primary ropes, or rope ends 16 fails. During normal operation, the end loop 12 supports the load. As such, the rope ends 16 remain slack and are not subjected to routine wear. If one of the rope leads 14 fails, the rope ends 16 will engage the respective load equalizing support members 24 to support the load. Moreover, in the event that one of the rope ends 16 fails, the second rope end 16 will support the load.

FIGS. 4A-9 show alternative rope terminations including alternative end sections that function to prevent a load imbalance of the two ropes, and that are designed so that in the event of a breakage in any one rope or rope connector, there will always be at least one other rope supporting the load.

The rope termination fitting described herein includes one or more load equalizing support members that receive rope ends or an attachment to the rope ends to prevent the ropes from being subject to an imbalanced load.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A load equalizing rope termination comprising:

a pair of rope ends;

a rope termination attached to the rope ends and defining an end section and a pair of rope leads, wherein the rope termination is connected from one of the pair of rope ends to the other of the pair of rope ends; and a rope termination fitting comprising:

a base support member over which the end section is supported, and a pair of load equalizing support members disposed upstream of the base support member and over which the rope ends are supported, the engagement between the rope ends and the load equalizing support members preventing a load imbalance of the rope leads.

2. A load equalizing rope termination according to claim 1, wherein the base support member and the load equalizing support members are angled in a direction opposite from a load direction.

3. A load equalizing rope termination according to claim 1, wherein the rope termination is spliced with the rope ends.

4. A load equalizing rope termination according to claim 1, wherein the rope ends support a load, each of the rope ends being capable of independently supporting the load, and wherein the load equalizing rope termination is assembled such that in upon breakage of either rope end or the rope termination, the other rope end will support the load.

5. A load equalizing rope termination comprising:

a pair of rope ends;

a rope termination attached to the rope ends and defining an end section and a pair of rope leads; and a rope termination fitting comprising:

a base support member over which the end section is supported, and a pair of load equalizing support members disposed upstream of the base support member and over which the rope ends are supported, the engagement between the rope ends and the load equalizing support members preventing a load imbalance of the rope leads, wherein the load equalizing support members are spaced from the base support member and aligned across a width of the base support member.

6. A load equalizing rope termination comprising:

a pair of rope ends;

a rope termination attached to the rope ends and defining an end section and a pair of rope leads; and a rope termination fitting comprising:

a base support member over which the end section is supported, and a pair of load equalizing support members disposed upstream of the base support member and over which the rope ends are supported, the engagement between the rope ends and the load equalizing support members preventing a load imbalance of the rope leads, wherein the end section comprises an end loop.

7. A load equalizing rope termination comprising:

a pair of rope ends;

a rope termination attached to the rope ends and defining an end section and a pair of rope leads, wherein the rope termination is connected from one of the pair of rope ends to the other of the pair of rope ends; and a rope termination fitting comprising means coupled with the rope ends for preventing a load imbalance of the rope leads.

8. A load equalizing rope termination comprising:

a pair of rope ends;

a rope termination attached to the rope ends and defining an end section and a pair of rope leads; and a rope termination fitting comprising means coupled with the rope ends for preventing a load imbalance of the rope leads, wherein the end section comprises an end loop.

9. A load equalizing rope termination according to claim 8, wherein the preventing means comprises:

a base support member over which the end loop is supported; and a pair of load equalizing support members disposed upstream of the base support member and over which the rope ends are supported.

10. A method of preventing a load imbalance on a rope termination defining an end section and a pair of rope leads, the method comprising:

attaching the rope termination to a pair of rope ends by connecting the rope termination from one of the pair of rope ends to the other of the pair of rope ends;

securing the end section over a base support member; and securing the rope ends over a corresponding pair of load equalizing support members disposed upstream of the base support member.

* * * * *